US005246339A

United States Patent [19]

Bengtsson et al.

[11] Patent Number: 5,246,339

[45] Date of Patent: Sep. 21, 1993

[54] GUIDE VANE FOR AN AXIAL FAN

[75] Inventors: Anders Bengtsson; Erik Böös, both of Växjö, Sweden

[73] Assignee: ABB Flakt AB, Stockholm, Sweden

[21] Appl. No.: 911,809

[22] Filed: Jul. 10, 1992

Related U.S. Application Data

[63] Continuation-in-part of Ser. No. 603,718, Nov. 26, 1990, abandoned.

[30] Foreign Application Priority Data

Jun. 8, 1988 [SE] Sweden ..... 8802136

[51] Int. Cl.[5] ..... F04D 29/44

[52] U.S. Cl. ..... 415/208.1; 415/211.2

[58] Field of Search ..... 415/208.1, 211.2, 191, 415/914

[56] References Cited

U.S. PATENT DOCUMENTS

| | | | |
|---|---|---|---|
| 1,502,865 | 7/1924 | Moody | 415/182.1 |
| 3,932,054 | 1/1976 | McKelvey | 415/130 |
| 4,318,669 | 3/1982 | Wennerstrom | 415/119 |
| 4,946,348 | 8/1990 | Yapp | 415/211.2 |

FOREIGN PATENT DOCUMENTS

| | | | |
|---|---|---|---|
| 2277257 | 7/1975 | France . | |
| 309375 | 7/1933 | Italy | 415/191 |
| 32005 | 4/1981 | Japan | 415/191 |
| 94040 | 1/1939 | Sweden . | |
| 477628 | 10/1969 | Switzerland . | |
| 941691 | 7/1982 | U.S.S.R. . | |
| 719061 | 11/1954 | United Kingdom | 415/191 |

*Primary Examiner*—John T. Kwon

*Attorney, Agent, or Firm*—Oblon, Spivak, McClelland, Maier & Neustadt

[57] ABSTRACT

A guide vane for an axial fan is formed in the end portion facing towards the fan with a web between the radially outer and inner portions of the guide vane. The arc length $L_2$ along the single-curved vane is shorter at the level of the web than at the outer and inner portions $L_3$ and $L_1$, respectively.

15 Claims, 2 Drawing Sheets

GUIDE VANE FOR AN AXIAL FAN

This application is a Continuation-In-Part of application Ser. No. 07/603,718, filed on Nov. 25, 1990, now abandoned.

BACKGROUND OF THE INVENTION

1. Field of the Invention
2. Discussion of the Background

The present invention relates to a guide vane for an axial fan.

When a gas passes through a fan the gas is deflected by the impeller rotor blades and a pressure increase is obtained across the impeller. However, this deflection means that the gas flow velocity has a rotational component after passage through the impeller. This rotational component forms rotational energy which is often lost in the continued gas transport downstream the fan.

It is known to arrange a ring of guide vanes downstream of the impeller to make use of this rotation energy and then raise the pressure increase of the fan as well as its efficiency. The rotation energy of the gas flow after the impeller is thus converted into a static pressure increase on passing over the guide vanes. This conversion is not free of losses, and to minimize the losses it is essential that the inlet angle of the guide vanes substantially coincides with the direction of gas flow leaving the impeller. If the inlet side of the guide vanes is not adapted to the direction of the impinging gas, a strong release of the flow is obtained at the guide vane, with large energy losses and an acompanying decrease of the fan efficiency as a result. The guide vanes are also implemented so that the gas on the outlet side is given a substantially axial directional component.

It has been found that the magnitude of the rotational component varies in the radial direction, which means that the angle which the flow direction forms with the central axis varies with the radius. The flow is very complex, and secondary effects result in the fact that the rotational component after the fan blades will be larger at the root and top of the blades. At the root of blades, i.e. at the point of attachment of the blades to the hub, the gas flow is given an increased rotational component by back flow in gaps and by the rotation of the hub, and at the top of the blades there is an increased rotation as a result of back flow which lowers the axial component. In addition, it should be noted that the exterior limiting surface, e.g. the wall of a flow duct or the like, not only retards the tangential movement component but also the axial one. Taken together this gives the unexpected radial variation of the flow direction illustrated in FIG. 1.

FIG. 1 thus illustrates the result of measurements made with an axial fan. As will be seen, the flow direction angle towards the central axis is greater at the top and root of the blade, and the angle passes through a minimum value therebetween. The exact appearance of the graph is affected by such parameters as the blade angles on the impeller and the selected operating point in the corresponding fan diagram (pressure flow diagram), but the shape of the graph is qualitatively the same, with a minimum between the positions of the blade root and top.

In attempts to adapt the inlet angle of the guide vane to the rotation component, which varies radially, guide vanes have been produced with varying curvature, which requires a very complicated manufacturing technique, however.

Guide vanes have also been made with an oblique edge between the inner and outer longitudinal edges of the guide vane, so that the arcuate length of the guide vane along the inner edge is longer than the arcuate length along the radially outer edge. For a constant curvature of the guide vane there is thus obtained a greater inlet angle at the radially inward portion of the guide vane than at its radially outward portion.

SUMMARY OF THE INVENTION

The object of the present invention is to provide a new guide vane, starting from the above-mentioned knowledge of the radial variation of the rotation, which vane is adapted on its inlet side to the direction of the impinging gas in a considerably improved way along the entire radial of the guide vane, while the guide vane is simple and cheap to manufacture.

This object is achieved with a guide vane of the kind stated in claim 1.

By giving the edge of the vane portion facing towards the axial rotor a configuration substantially following the variation of the rotation illustrated in FIG. 1, the vane can be produced with a single curvature and simultaneously obtains excellent adaption of the inlet angle to the direction of the impinging gas at every point.

With the guide vane in accordance with the invention, improvements in fan efficiency of up to 20% can be obtained as compared with guide vanes generally available on the market.

In accordance with an advantageous embodiment of the inventive guide vane, the inlet angle $\alpha_1$ at the radially inward portion or root portion meets the condition:

$$40^\circ < \alpha_1 < 70^\circ \text{ and}$$

preferably $$52^\circ < \alpha_1 < 70^\circ.$$

According to another advantageous embodiment of the inventive guide vane having a constant radius of curvature, the ratio between the radius of curvature R and the length $L_1$ of the radially inward edge of the guide vane meets the condition:

$$0.83 < R/L_1 < 1.45 \text{ and}$$

preferably $$0.83 < R/L_1 < 1.10.$$

Optimization of the guide vane configuration to the selected operating point in the area in the pressure-flow diagram which is of interest is thus enabled.

According to a still further advantageous embodiment of the inventive guide vane, the relationship between the length $L_1$ of the radially inward edge of the guide vane and the length $L_2$ of the guide vane at the level of the web meets the condition:

$$1.25 < L_1/L_2 < 3.0$$

and the web level is given by the condition:

$$0.4 < H_1/H_2 < 0.9$$

preferably $$0.5 < H_1/H_2 < 0.8$$

where H denotes the height for the web position from the radially inward edge and $H_2$ represents the total height of the guide vane.

The inlet angle of the guide vane at the vane top must be related, e.g. to the inlet angle at the guide vane root, and according to another advantageous embodiment of the inventive guide vane this relationship is given by the condition:

$$0.5 \leqq L_3/L_1 \leqq 0.7$$

where $L_3$ and $L_1$ denote the lengths of the radially outer and inner edges of the guide vane.

If the above indicated limits of the different parameters determining the configuration of the guide vane are exceeded, disturbances of different kinds occur, e.g. separation of the gas flow from the guide vane with energy losses as a result.

Embodiments of the guide vane in accordance with the invention, selected as examples, will now be described in more detail in connection with FIGS. 2-5.

DESCRIPTION OF THE PREFERRED EMBODIMENTS

Figure 1:
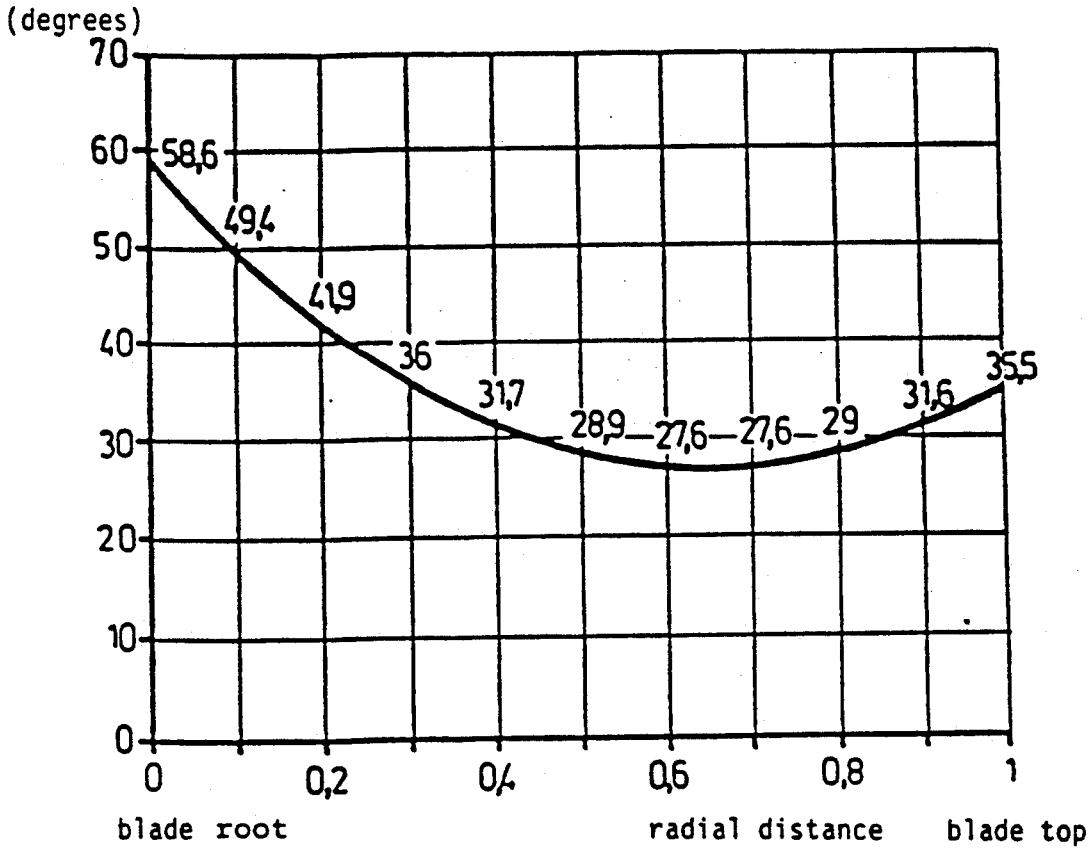
FIG. 1 illustrates the radial variation of the angle between the flow direction and the central axis from the blade root to the blade top.
Figure 2:
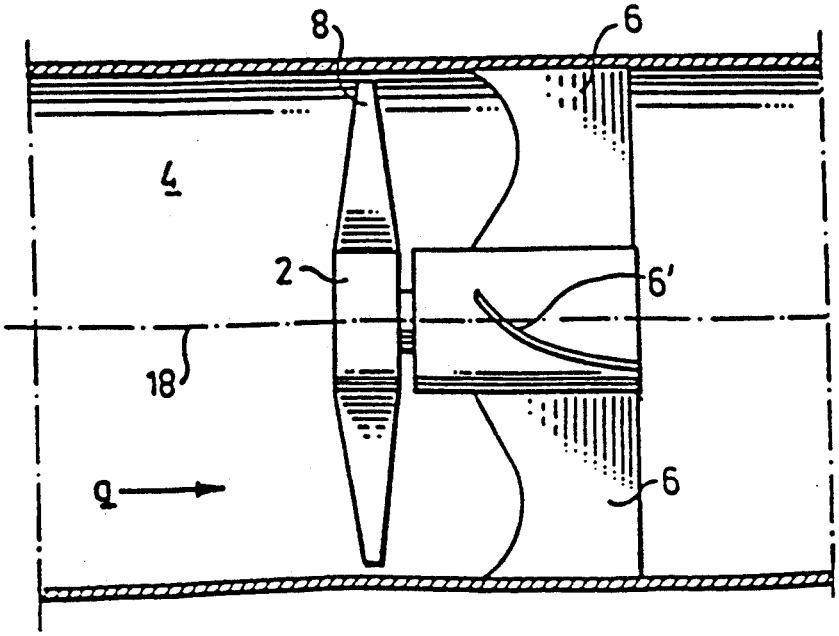
FIG. 2 illustrates an axial fan with guide vanes arranged downstream in accordance with the invention.

In FIG. 2 there is illustrated an axial fan 2, installed in a duct 4, with the air flow direction indicated by the arrow q. Downstream the fan and at a given distance from it a ring of guide vanes 6 is mounted, the radial extension of the guide vanes substantially corresponding to that of the fan blades 8. As will be particularly seen from the vane 6', the vanes have a substantially axial outlet angle while the inlet angle forms a given angle to the central axis of the fan.

Figure 3:
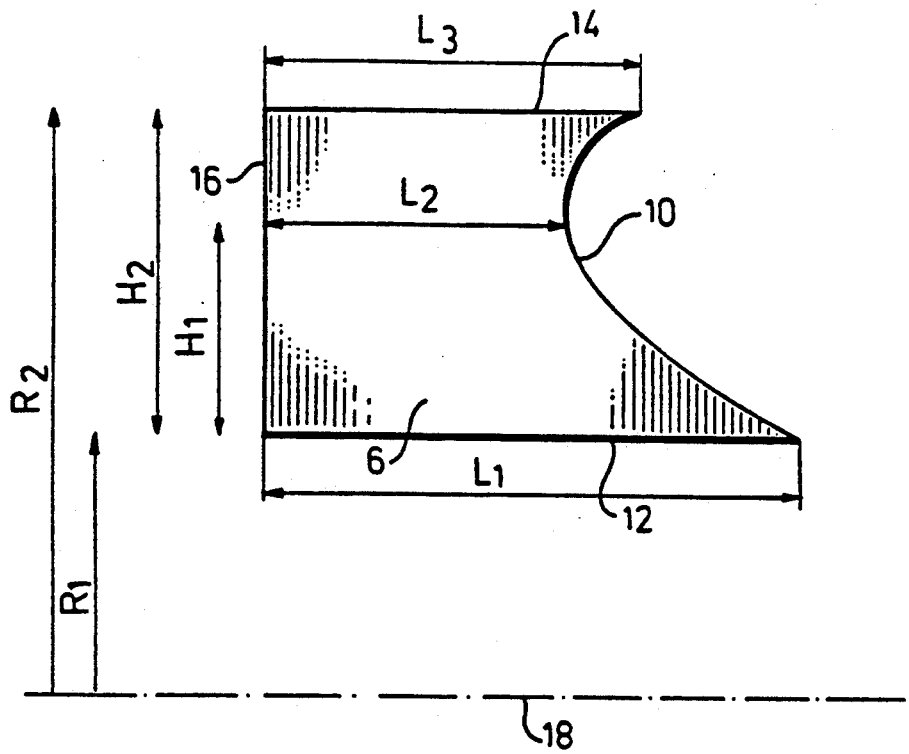
FIG. 3 illustrates a preferred embodiment of the inventive guide vane extended in a plane.

In FIG. 3 there is illustrated a preferred embodiment of a guide vane 6, extended in a plane. The end portion of the guide vane 6 which is intended to face towards the fan has a front edge 10 with a parabola like shape so that between the radially inner and outer longitudinal edges 12 and 14 of the guide vane 6 there is obtained a web with a shorter length $L_2$ along the vane than said edges $L_1$ and $L_3$. The vane 6 has a straight trailing edge 16.

The height of the web from the inner longitudinal edge 12 is denoted by $H_1$ and the total height of the vane by $H_2$. The position of the web is determined by the condition:

$$0.4 < H_1/H_2 < 0.9 \text{ and}$$

preferably $$0.5 < H_1/H_2 < 0.8.$$

Figure 4:
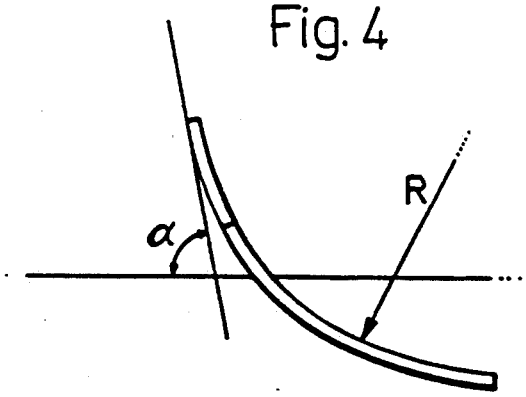
FIG. 4 illustrates the guide vane of FIG. 3 with constant curvature.

When the guide vane of FIG. 3 is given a constant curvature with a radius of curvature R according to FIG. 4, there is obtained a greater inlet angle in relation to the central axis at the inner portion of the guide vane, which will be at the level of the blade root, that at the outer portion of the vane 6, which will be at the level of the vane top, since the inner longitudinal edge 12 is no longer than the outer longitudinal edge 14, see FIG. 3. In the intermediate web portion, the inlet angle will be still less, and thus there is achieved in a simple way a radial variation in the inlet angle which agrees with the radial variation of the gas flow rotation component, as discussed above.

$$\text{For } 0.50 \leqq L_3/L_1 \leqq 0.70$$

there are obtained the ratios between the inlet angles at the outer and inner portions of the vane, which are well suited to practical applications.

The lengths $L_1$ and $L_2$ meet the condition:

$$1.8 < L_1/L_2 < 2.3$$

To enable optimization of the guide vane at different operating points in the pressure-flow diagram, i.e. both for large flow and high pressure, the radius of curvature R, see FIG. 4, and $L_1$ must meet the condition:

$$1.25 < L_1/L_2 < 3.0$$

preferably $$0.83 < R/L_1 < 1.10$$

The ratio between the radii $R_1$ and $R_2$ from the central axis 18 of the fan to the inner edge 12 of the guide vane and the outer edge 14, respectively, meets the condition:

$$0.3 \leqq R_1/R_2 \leqq 0.8 \text{ and}$$

preferably $$0.45 < R_1/R_2 < 0.72$$

The vane will thus be useful for practically all axial fans used in practice.

In addition, $R_1$ corresponds to the radius of the impeller hub, while the radius $R_2$ corresponds to the radius in the flow duct 4 in question, which also substantially agrees with the radius of the blade wheel, cf. FIG. 2.

Figure 5:
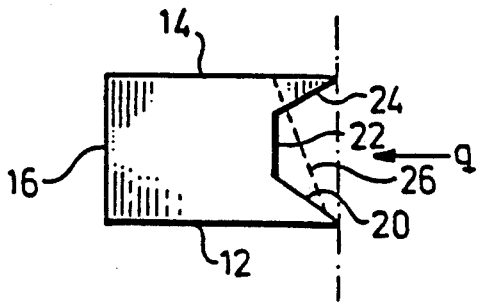
FIG. 5 illustrates an alternative embodiment of the guide vane in accordance with the invention, also extended in a plane.

In FIG. 5 there is illustrated an alternative embodiment of a guide vane in accordance with the invention, the edge which is intended to face towards the fan being formed by a polygonal train of three sides 20, 22, 24 (i.e., is trilateral). The side 22 will then form the intermediate web portion. It should be noted that the web portion 22 is displaced closer to the outer edge 14, as compared with the inner edge 12. This vane is also curved with a constant radius of curvature, as illustrated in FIG. 4. This is a simple guide vane configuration, which provides a considerable increase in efficiency as compared with previous embodiments with a monotonously extending oblique edge, as indicated by the dashed line 26 in the figure.

It will be obvious that a number of curved shapes are possible for the edge facing towards the fan, these shapes having a web as described above. In practical application the curve shape giving an optimum result is of course selected.

We claim:

1. Guide vane for an axial fan, which comprises:

a curved guide vane having radially inner and outer portions; and a web formed between said radially inner and outer portions of the guide vane along a portion of the guide vane facing toward the fan wherein the arc length along the curved guide vane at the level of the web is shorter than at said inner and outer portions of said guide vane and wherein the ratio between the length $L_1$ of the radially inner edge of the guide vane and the length $L_2$ of the guide vane at the level of the web meets the condition:

$$1.25 < L_1/L_2 < 3.0.$$

2. Guide vane as claimed in claim 1, wherein the edge of the front end portion facing towards the fan has a continuous concave shape.

3. Guide vane as claimed in claim 2, wherein the front edge has a parabolalike shape.

4. Guide vane as claimed in claim 1, wherein the edge of the front end portion facing towards the fan has the shape of a polygonal train.

5. Guide vane as claimed in claim 4, wherein the edge of the front end portion facing towards the fan has the form of a trilateral polygonal train.

6. Guide vane as claimed in claim 1, wherein the inlet angle $\alpha$, at the root portion of the guide vane meets the condition $$40° < \alpha_1 < 70°.$$

7. Guide vane as claimed in claim 6, wherein the inlet angle $\alpha$, at the root portion of the guide vane meets the condition $52° < \alpha_1 < 70°$.

8. Guide vane as claimed in claim 1, wherein the single-curved guide vane has a constant radius of curvature R.

9. Guide vane as claimed in claim 8, wherein the ratio between the radius of curvature R and the length $L_1$ of the radially inner edge of the guide vane meets the condition $$0.83 < R/L_1 < 1.45$$

10. Guide vane according to claim 9, wherein the ratio between the radius of curvature R and the length $L_1$ of the radially inner edge of the guide vane meets the condition $0.83 < R/L_1 < 1.10$.

11. Guide vane as claimed in claim 1, wherein the ratio between the height $H_1$ of the position of the web from the radially inner edge and the total height $H_2$ of the guide vane meets the condition $$0.4 \leqq H_1/H_2 < 0.9.$$

12. Guide vane as claimed in claim 11, wherein the ratio between the height $H_1$ of the position of the web from the radially inner edge of the total height $H_2$ of the guide vane meets the condition $$0.5 < H_1/H_2 < 0.8.$$

13. Guide vane as claimed in any one of claim 1, wherein the ratio between the lengths $L_3$ and $L_1$ of the radially outer and inner edges respectively of the guide vane meets the condition $$0.5 \leqq L_3/L_1 \leqq 0.7.$$

14. Guide vane as claimed in any one of claim 1, wherein the ratio between the radii $R_1$ and $R_2$ from the fan axis to the outer and inner edges, respectively, of the guide vane meets the condition $$0.3 \leqq R_1/R_2 \leqq 0.8.$$

15. Guide vane according to claim 14, wherein the ratio between the radii $R_1$ and $R_2$ from the fan axis to the outer and inner edges of the guide vane meets the condition $$0.45 < R_1/R_2 < 0.72.$$

* * * * *

UNITED STATES PATENT AND TRADEMARK OFFICE

CERTIFICATE OF CORRECTION

PATENT NO. : 5,246,339

DATED : September 21, 1993

INVENTOR(S) : Anders Bengtsson et al.

It is certified that error appears in the above-indentified patent and that said Letters Patent is hereby corrected as shown below:

On the title page, Item [30],

The Foreign Application Priority Data, should read:

--Jun. 8, 1988 [SE] Sweden.....8802136

Jun. 8, 1989 [PCT] PCT.....PCT/SE89/00324--

Signed and Sealed this

Fifth Day of April, 1994

Bruce Lehman

*Attest:*

BRUCE LEHMAN

*Attesting Officer*

*Commissioner of Patents and Trademarks*